United States Patent [19]

Auel

[11] Patent Number: 5,024,486

[45] Date of Patent: Jun. 18, 1991

[54] ALL-PURPOSE ROCKING, SWIVELING, RECLINING, AND LIFTING CHAIR

[76] Inventor: Carl C. Auel, 14 Fifth Ave., Herminie, Pa. 15637

[21] Appl. No.: 504,114

[22] Filed: Apr. 3, 1990

[51] Int. Cl.[5] ..... A47C 1/02

[52] U.S. Cl. ..... 297/330; 297/85; 297/DIG. 10

[58] Field of Search ..... 297/330, DIG. 10, DIG. 7, 297/83, 85, 84; 298/393–398

[56] References Cited

U.S. PATENT DOCUMENTS

| | | | |
|---|---|---|---|
| 3,596,991 | 8/1971 | McKee et al. | 297/330 |
| 4,083,599 | 4/1978 | Gaffney | 297/330 |
| 4,179,157 | 12/1979 | Shoemaker et al. | 297/83 |
| 4,212,495 | 7/1980 | Gall | 297/84 |
| 4,384,698 | 5/1983 | Courtois et al. | 297/330 |
| 4,850,645 | 7/1989 | Crockett | 297/347 |
| 4,852,939 | 8/1989 | Krauska | 297/330 |
| 4,909,569 | 3/1990 | Gaffney | 297/327 |

*Primary Examiner*—Kenneth J. Dorner
*Assistant Examiner*—James M. Gardner
*Attorney, Agent, or Firm*—Reed Smith Shaw & McClay

[57] ABSTRACT

The present invention provides for a power operated chair that can be operated in a rock and swivel, recline, or lift mode or any combination thereof. The chair is specifically designed to prevent the rocking and swiveling motion when the occupant is using the lift or recline features of the chair. The chair uses a recline mechanical linkage and a seat lift mechanical linkage that are mechanically linked by a guide roller in a guide channel which permits the use of a single drive motor and provides for a smooth transition from the recline mode to the lift mode. The guide roller and guide channel also prevent the inadvertent lifting of the seat if the back of the chair is forcibly reclined.

19 Claims, 6 Drawing Sheets

ALL-PURPOSE ROCKING, SWIVELING, RECLINING, AND LIFTING CHAIR

The present invention relates to a power operated chair that has the capability to rock and swivel, recline while moving away from a wall, and lift the occupant of the chair.

BACKGROUND OF THE INVENTION

A variety of chairs have been known and used that feature the capability either to rock, swivel, recline, lift, or perform some combination of these activities. In particular, U.S. Pat. Nos. 3,039,818 (Frank); 3,138,402 (Heyl, Jr., et al.); 3,479,086 (Sheridan); 3,640,566 (Hodge); 4,007,960 (Gaffney); 4,083,599 (Gaffney); 4,226,468 (Johnson); 4,850,645 (Crockett); and 4,852,939 (Krauska) all disclose chairs that feature one or more of these capabilities. None of these patents, however, disclose a power operated chair that is capable of performing the combined functions of rocking and swiveling as well as reclining and lifting.

In addition to the inability to perform all of the features of the chair disclosed in the present invention, each of the devices in the above listed patents has other disadvantages. For example, Frank discloses a chair with lift capabilities only that simply relies on springs for the lift operation; the present invention, on the other hand, uses a power activated mechanism to accomplish all of the chair's operations. Heyl provides for a motor operated lift mechanism for a chair, but does not provide for a motor operated recline mechanism or the rock and swivel feature of the present invention. Further, the present invention for ease of operation lifts only the seat, rather than the seat and back as in Heyl. Likewise, Sheridan provides only for a mechanism that can lift the seat. Hodge provides for a lift and recline mechanism, but, unlike the present invention, this mechanism is only spring assisted and not power operated. Both Gaffney patents disclose chairs capable of lift and recline operations, but they cannot rock and swivel as can the present invention. Johnson discloses a chair that is capable of moving away from the wall as it reclines, but it does not disclose any of the lift or rock and swivel features of the present invention. Crockett discloses a lifting device for the entire chair, rather than the present invention which provides for an integrated chair that lifts the seat as well as reclines, rocks, and swivels. Similarly, Krauska discloses a device to take an existing reclining chair and turn it into a powered lift and reclining chair, but does not incorporate these features into a chair that also rocks and swivels and lifts only the seat rather than the entire chair.

It would be desirable, therefore, to provide for a power operated chair that could not only recline and lift the occupant of the chair, but also rock and swivel.

SUMMARY OF THE INVENTION

The present invention provides a power-operated, multi-position chair having a mainframe, a seat attached to the mainframe, two armrests attached to the seat, a back attached at back pivots to the main frame, a footrest attached to the mainframe, and a switch to control the chair's positions comprising: a recline mechanical linkage that allows the chair to recline the back, lift the front of the seat, and lift the footrest; a seat lift mechanical linkage that allows the chair to lift the back of the seat; a guide roller mechanically linked to both the recline mechanical linkage and the seat lift mechanical linkage; a guide channel in which the guide roller operates to activate either the recline mechanical linkage or the seat lift mechanical linkage; and a single power source with mechanical means to move the guide roller in the guide channel so that the chair can operate through its recline and seat lift modes. This use of a guide roller in a guide channel to operate the chair also prevents the inadvertent lifting of the seat if the back of the chair is forcibly reclined.

In one embodiment of this invention, a rock and swivel means is added to the chair. The power source with mechanical means moves the chair from the rock and swivel mode, in which the chair is supported by the rock and swivel means, to either the recline or the seat lift mode by using wheels with a flat side, positioned with the flat side facing the floor when the chair is supported on the rock and swivel base, that rotate forward or backward to support the chair directly from the rounded portion of the wheels during recline or seat lift operations.

The chair is designed so that it can be built in any one of four configurations, namely: (1) a chair with seat lift capabilities only, (2) a chair with both seat lift and recline capabilities, (3) a chair with seat lift, recline, and rock and swivel capabilities, or (4) a chair with all three capabilities that moves forward as it reclines so that the chair can be located next to a wall in its normal upright position (such as a Wall Hugger® type chair).

In the first two configurations, the chair can be built with traditional feet supporting the main frame. In the latter two configurations, namely rock and swivel or forward recline configurations, the chair features the wheels with a flat side to support the main frame. Alternatively, configuration (3) can be built by replacing these wheels and their chain drive mechanism with a simpler support device, such as an inverted "T" structural member, and a linkage drive mechanism that moves forward or backward to support the chair and prevent rocking and swiveling while the chair operates in its lift or recline modes. In any of the configurations with recline capability, the chair can be equipped with an adjustable footrest mechanism that allows the user to return the back to an upright position while maintaining an elevated position for the footrest.

All operations in any configuration of the chair are powered by a single motor that operates through a simple rocker switch, preferably located on one of the arm rests. If the chair includes the rock and swivel mode, a small white indicator light near the switch comes on to indicate when the chair is supported by the swivel base and the wheels are in a position to allow for maximum rocking action. A red indicator light near the switch comes on whenever the chair is supported by the rock and swivel means to show a user that the chair could rock or swivel if the user tries to sit in it.

BRIEF DESCRIPTION OF THE DRAWINGS

In the accompanying drawings, a preferred embodiment of the present invention is illustrated, by way of example, wherein.

DESCRIPTION OF THE PREFERRED EMBODIMENT

Figure 1:
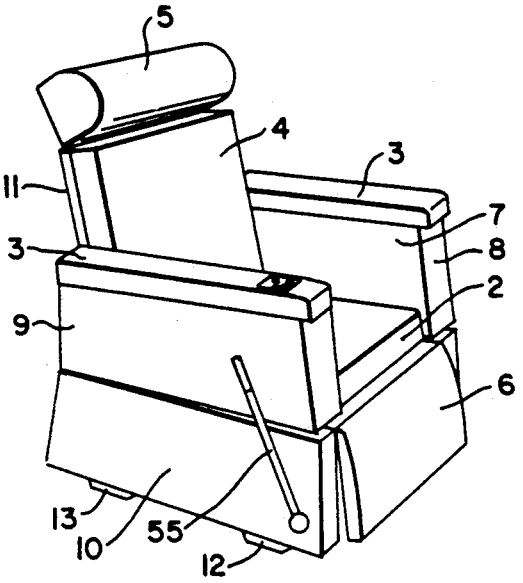
FIG. 1 shows a perspective view of the chair in the rock and swivel mode.
Figure 2:
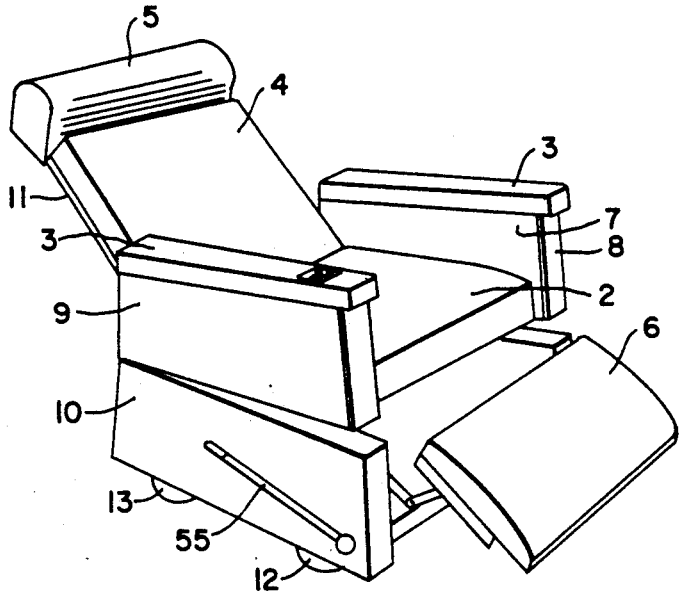
FIG. 2 shows a perspective view of the chair in the recline mode.
Figure 3:
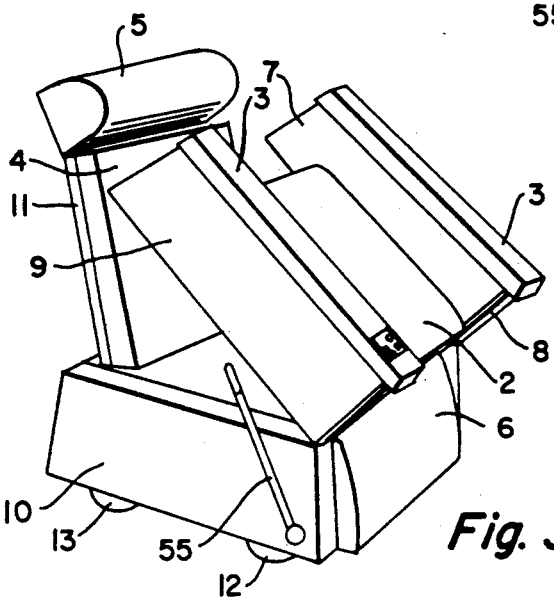
FIG. 3 shows a perspective view of the chair in the lift mode.

FIGS. 1, 2, and 3 show the preferred embodiment of the chair of the present invention in its respective rock and swivel, recline, and lift modes. With the exception of the control switch 1 (see FIG. 4), the exterior components of the chair are similar to those found in everyday furniture, namely a seat 2, two armrests 3, a back 4 with an adjustable headrest 5, and a footrest 6. In addition to these padded portions of the chair that are removable, the finishing panels of the chair, namely the two inside arm panels 7, the two front arm panels 8, the two outside arm panels 9, the two lower skirt panels 10, and the back panel 11, are all removable for easy cleaning and reupholstering.

The chair features four wheel-like supports, two front wheels 12 and two rear wheels 13, that include a flat side in lieu of a portion of the wheel's circumference. When the chair is in the rock and swivel mode shown in FIGS. 1 and 5, the wheels 12 and 13 are positioned so that the flat sides of the wheels face the floor, and the chair is, therefore, lowered so that its weight is supported on a swivel base 14 and the chair's springs 15 (see FIG. 6) and rocker contact 16 are engaged to allow the occupant to rock and swivel the chair. When the chair is in the recline mode shown in FIGS. 2 and 7 or the lift mode shown in FIGS. 3 and 9, the wheels 12 and 13 are positioned so that the flat spot no longer faces the floor and the chair is supported directly on the wheels, thus disengaging the swivel base 14, the springs 15, and the rocker contact 16 so that the chair cannot rock or swivel for safety reasons when used in these modes.

Figure 5:
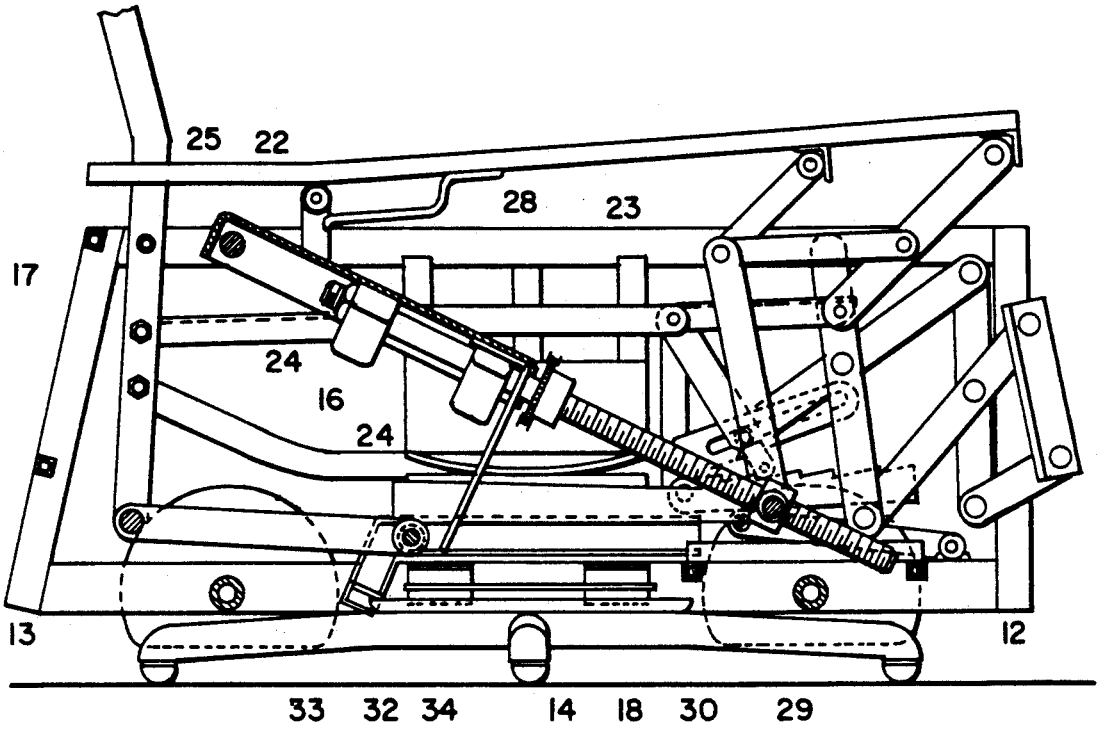
FIG. 5 shows a side view of the chair assembly in the rock and swivel mode.
Figure 6:
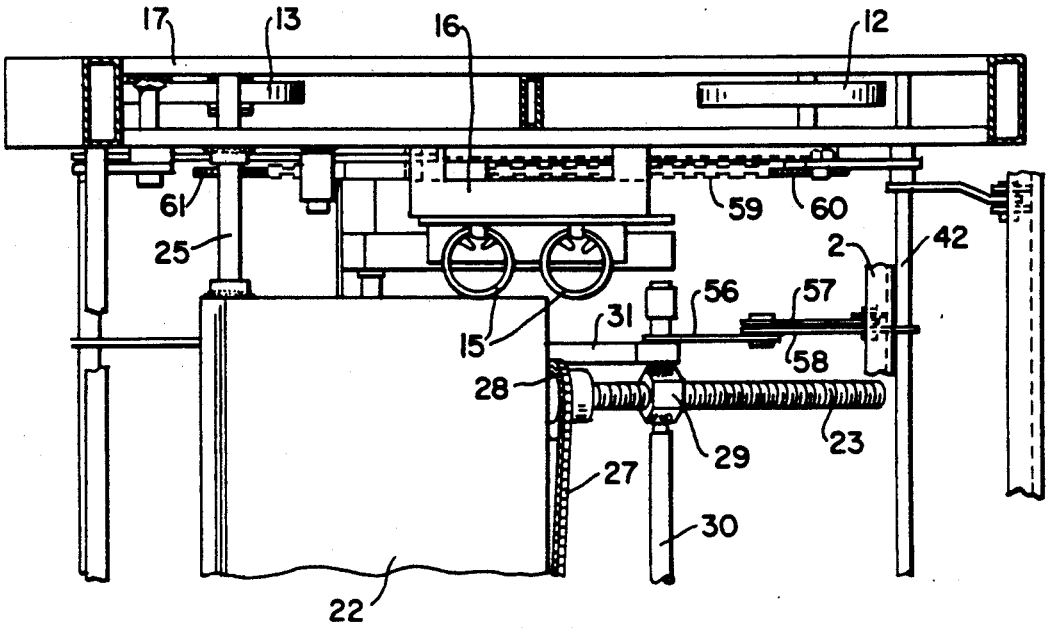
FIG. 6 shows a plan view of the chair assembly.

As shown in FIGS. 5 and 6, the rocking capability of the chair is accomplished through the use of four springs 15 that are mounted to the rocker contact 16 on one end and mounted to the swivel base 14 on the other. The rocker contact 16, in turn, mounts directly on the main frame 17 of the chair. In the rock and swivel mode with the wheels 12 and 13 positioned so that the flat sides of the wheels face the floor, the weight of the main frame 17 is supported on the swivel base 14 at the rocker contact 16. The swivel component 18 of the swivel base 14 allows the chair to turn, while the springs 15 and the engagement of the rocker contact 16 to the swivel base 14 allow the chair to rock. When the chair is powered into its recline or lift mode, the wheels also are powered forward (recline mode) or backward (lift mode) to turn the flat side of the wheel away from the floor, thus supporting the main frame 17 directly on the wheels 12 and 13, rather than the swivel base 14, and disabling the rocking and swiveling mechanisms.

Figure 4:
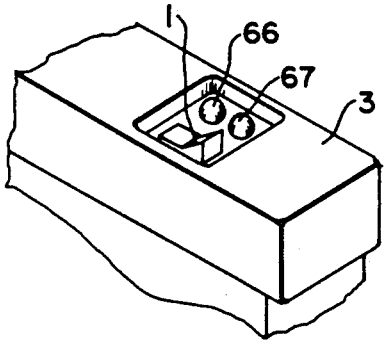
FIG. 4 shows a fragmentary perspective view of the control switch and indicator lights for operating the chair.
Figure 8:
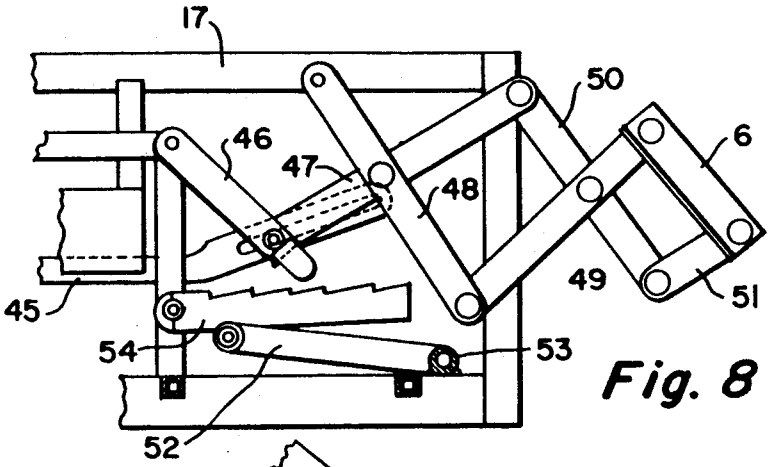
FIG. 8 shows a side view of the chair assembly in the recline mode featuring the details of the footrest mechanism.

Referring to FIGS. 4 and 8, all operations of the chair are accomplished using just one switch 1 and one motor 19. Power to move the chair from one position to another is supplied by a 1/5 horsepower, 100 inch-pound, 110 volt AC motor 19 geared down to 100 RPM. This motor 19 is completely insulated from the main frame 17 to prevent any electrical leakage and is controlled by a 24 volt reversing relay 20 to limit the voltage at the control switch 1 to only 24 volts. The electrical control mechanism is enclosed completely in a box 21 made from an insulating material such as Lexan® to make it shock proof and fire resistant.

Figure 10:
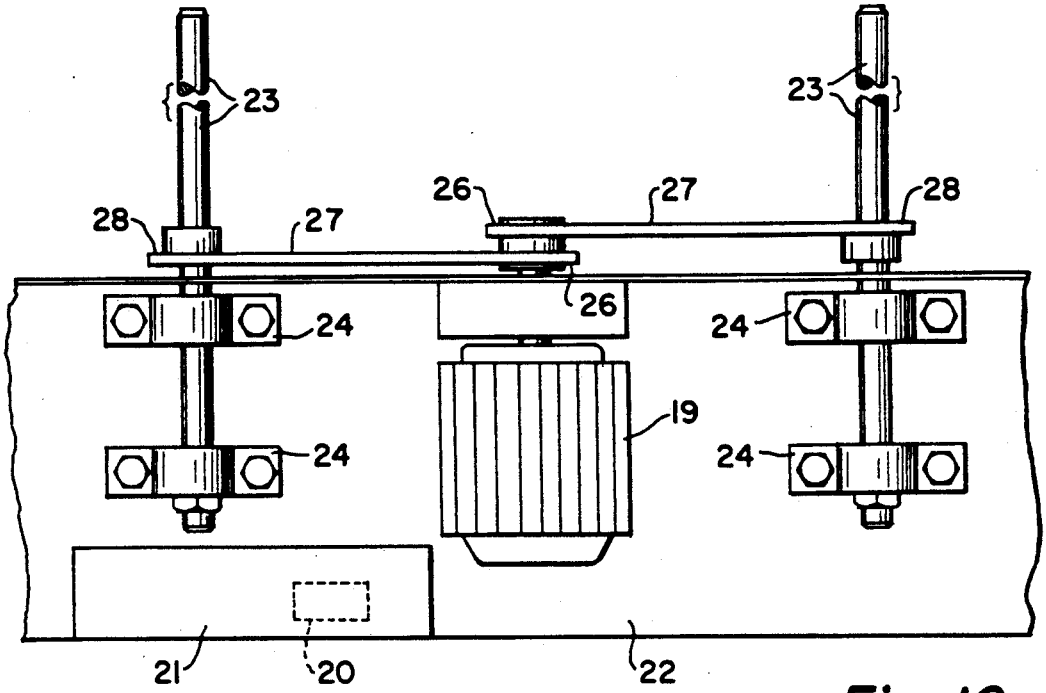
FIG. 10 shows a bottom view of the chair assembly featuring the motor mounting and electrical control locations.
Figure 11:
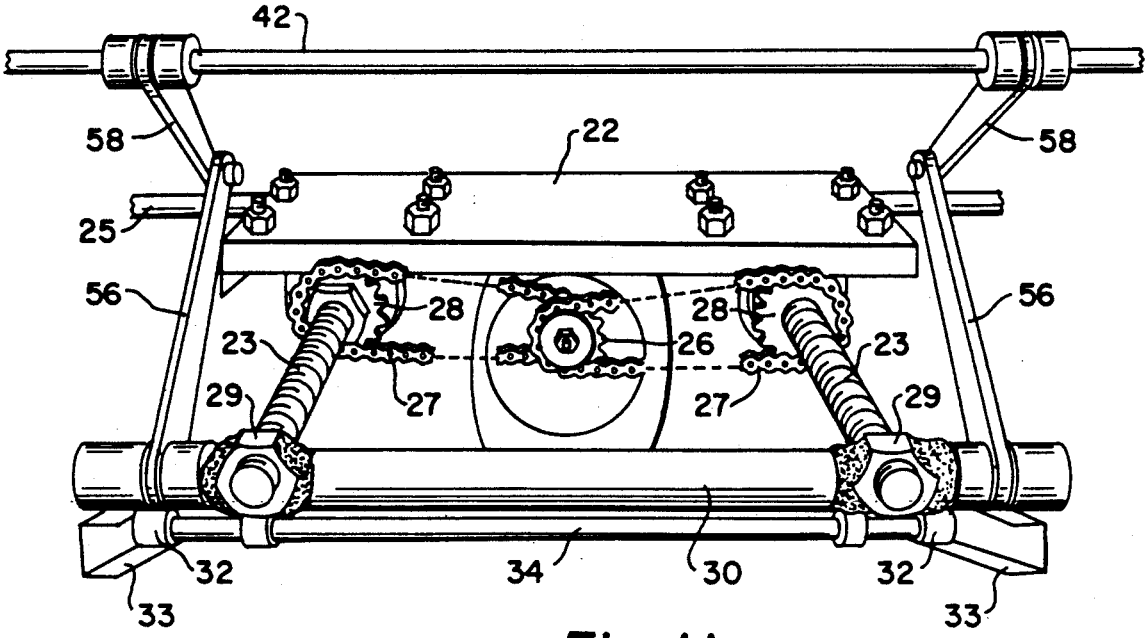
FIG. 11 shows a front view of the chair assembly featuring the details of the power drive mechanism.

As shown in FIGS. 10 and 11, the motor 19 is mounted on a motor mount plate 22 along with two power screws 23 that are each held in two pillow block bearings 24 attached to the motor mount plate 22. The motor mount plate 22 is attached to the main frame 17 at the motor mount pivot cross bar 25. Two motor sprockets 26 are attached to the power shaft of the motor 19 to drive each power screw 23 by use of a screw chain 27 and a screw sprocket 28 mounted to each power screw 23. This drive train keeps the entire mechanism in mechanical balance from side to side. The screw sprockets 28 are made from nylon or a similar material to prevent electrical leakage to the main frame 17.

The two power screws 23 engage two nuts 29 mounted on the main power cross bar 30. When the power screws 23 turn counterclockwise (as viewed from the motor 19) to push the power cross bar 30 away from the motor 19, the chair reclines. When the power screws 23 turn clockwise (as viewed from the motor 19), they pull the power cross bar 30 toward the motor 19 so that the chair pushes the back 4 upright, while lowering the footrest 6, and then lifts the seat 2.

Referring to FIGS. 5 and 6, each end of the power cross bar 30 is attached in a pivotal manner to the front end of a lower power bar 31 located on each side of the chair. Attached to the rear end of each lower power bar 31 is a guide roller 32 that moves forward or backward in the guide channels 33 on each side of the chair. These horizontal guide channels 33 (see FIG. 12) are bent downward at a 70° angle at their rear end position. In the preferred embodiment, the guide rollers are connected to each other by a guide cross bar 34 to stabilize the operation of the chair from side to side.

The guide channels 33 function to allow limited and guided motion of the entire mechanism from the seat lift position in which the guide rollers are at the lower region of the bent part of the guide channels 33 to the upright position in which the guide rollers 32 are at the upper region of the bent part of the guide channels 33 to the fully reclined position in which the guide rollers 32 are at the front end of the guide channels 33. The bent part of the guide channels acts as a safety measure to lock the back 4 in an upright position so that no one can pull the back 4 in a manner that would lift the seat 2 up, thus endangering the occupant of the chair.

Figure 7:
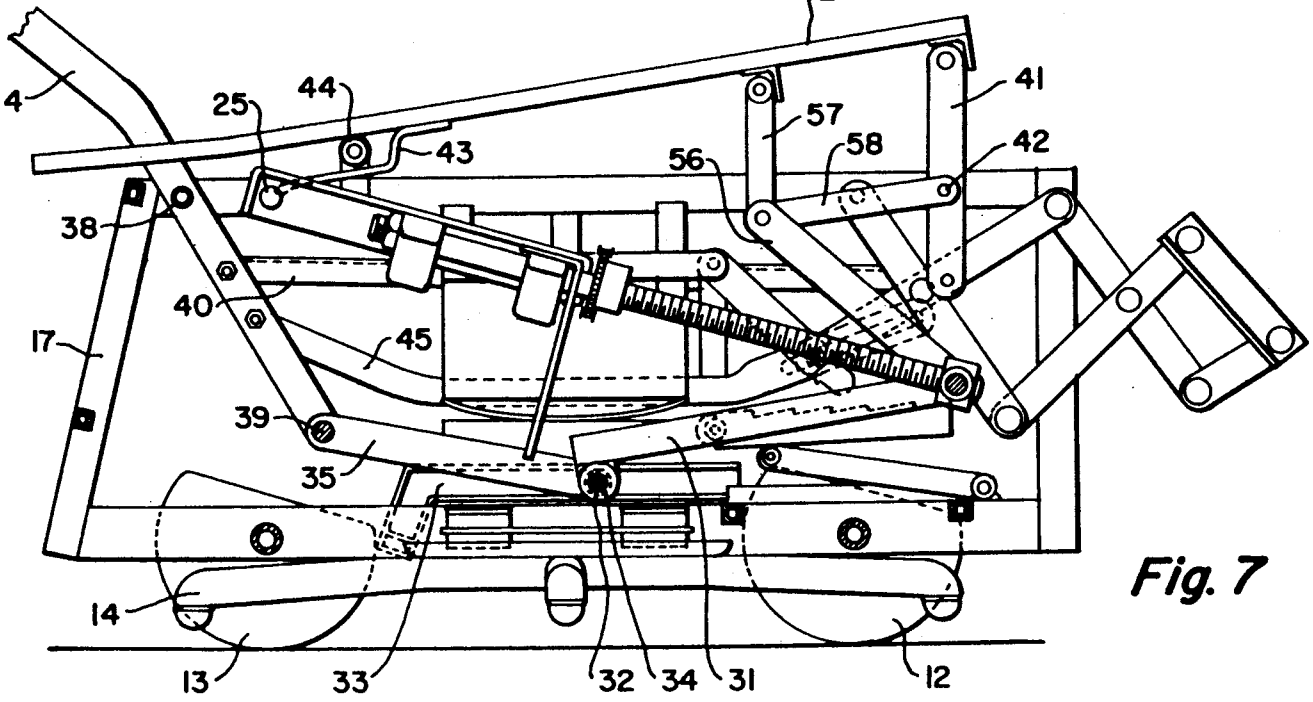
FIG. 7 shows a side view of the chair assembly in the recline mode.
Figure 12:
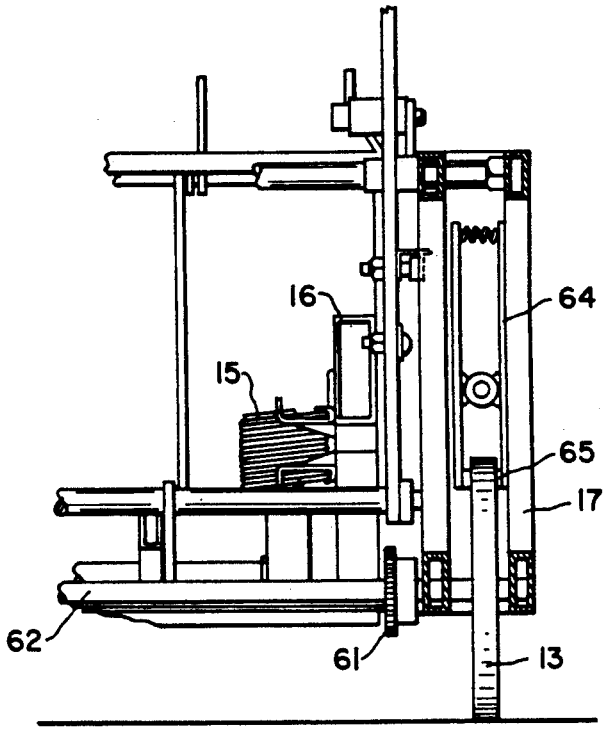
FIG. 12 shows a side view of the chair assembly featuring the details of the chain drive mechanism.

In order to actuate the reclining feature of the chair illustrated in FIGS. 2, 7, and 12, the rear ends of the lower power bars 31 are also connected in a pivotal manner to the front end of first recline linkages 35 on each side of the chair. The rear ends of the first recline linkages 35 connect in a pivotal manner to the bottom of the back 4 to impart motion to the back 4 and, in turn, are also connected in a pivotal manner to the rear end of chain drive bars 36 on each side of the chair. The front ends of the chain drive bars 36 are connected in a pivotal manner and impart motion to the chain turnbuckles 37 on each side of the chair to move the wheels 12 & 13 forward and backward.

The back 4 is attached to the main frame 17 at two back pivots 38 on each side. The forward motion of the first recline linkages 35 pull the bottom of the back 4 forward to recline the top of the back 4 about the back pivots 38. In the preferred embodiment, a back cross bar 39 is attached at each end to the connection point of the first recline linkages 35 with the back 4 to stabilize the operation of the chair from side to side. The forward motion of the first recline linkages 34 also pulls the chain drive bars 35 forward to move, in turn, the wheels 12 and 13 in a forward direction. This feature allows the chair to be positioned with the back 4 against a wall and still accommodate the reclining mode because the chair moves forward as it reclines.

Second recline linkages 40 on each side of the chair connect in a pivotal manner at their rear ends to a point on the back 4 below the back pivots 38 and at their front ends in a pivotal manner to the lower end of the seat rockers 41 on each side of the chair. The seat rockers 41 are attached in a pivotal manner at their upper ends to the front of the seat 2, with a connection to the main frame at the seat pivot cross bar 42 to raise the front of the seat 2 while moving the seat 2 backward to fill the gap between the seat 2 and the back 4 as the back 4 reclines. This mode of operation keeps the occupant's legs in a partially flexed and more comfortable position. Seat keepers 43 are mounted on each side of the rear of the seat 2 and slide under seat rollers 44 mounted on the main frame 17 on each side of the chair to properly position the seat 2 as it moves backward in the recline mode. The restriction of the seat keepers 43 under the seat rollers 44 also insures that the seat 2 cannot operate in the lift mode, as detailed later, until all four wheels 12 & 13 are firmly in contact with the floor to make the chair stable.

Referring to FIGS. 7 and 8, third recline linkages 45 on each side of the chair attach in a pivotal manner at their rear ends to a point at the back 4 below the back pivots 38 and at their front ends through a slot to the lower ends of first footrest pantograph linkages 46 on each side of the chair to raise the foot rest 6. The lower ends of the first footrest pantograph linkages 46 are also connected in a pivotal manner to the lower ends of the second footrest pantograph linkages 47 while the upper ends of the first footrest pantograph linkages attach in a pivotal manner to the main frame 17 of the chair. The upper ends of the second pantograph linkages 47 attach in a pivotal manner to the upper ends of the fifth pantograph linkages 50 and are also connected in a pivotal manner at midpoints to midpoints of the third pantograph linkages 48. The upper ends of the third pantograph linkages 48 attach in a pivotal manner to the mainframe 17 while the lower ends connect in a pivotal manner to the lower ends of the fourth pantograph linkages 49. The upper ends of the fourth pantograph linkages 49 attach to the upper end of the footrest 6 and are also connected in a pivotal manner at midpoints to midpoints on the fifth pantograph linkages 50. The lower end of the fifth pantograph linkages 50 attach in a pivotal manner to the lower end of the sixth pantograph linkages 51. The upper ends of the sixth pantograph linkages 51 are attached to the lower end of the footrest 6.

Adjustable footrest lift bars 52 on each side of the chair connect at their lower ends to each end of an adjustable footrest cross bar 53 mounted on the lower part of the mainframe 17. The adjustable footrest lift bars 52 are positioned so that they are in contact with adjustable footrest lift supports 54 that are mounted in a pivotal manner to each side of the main frame 17 of the chair. The adjustable footrest cross bar 53 is also connected at one end to a footrest handbar 55 (see FIG. 1) that is positioned on the outside of the chair so that an occupant can reach the footrest handbar 55 when in a seated position. Manual forward movement of the footrest handbar 55 moves the adjustable footrest lift bars 52 that in turn push the adjustable footrest lift supports 54 to a position in which a scalloped edge of the adjustable footrest lift supports 54 engages a hook on the lower end of the first pantograph linkages 47 so that the footrest 6 remains in its last elevated position even if the back of the chair is returned to an upright position. The footrest 6 returns to its normal position only when the chair is reclined to a position in which the slot in the third recline linkages 45 reengages the lower ends of the first pantograph linkages 46, thereby pushing the first pantograph linkages 46 upward and disengaging the adjustable footrest lift supports 54, which then drop to their disengaged position.

Figure 9:
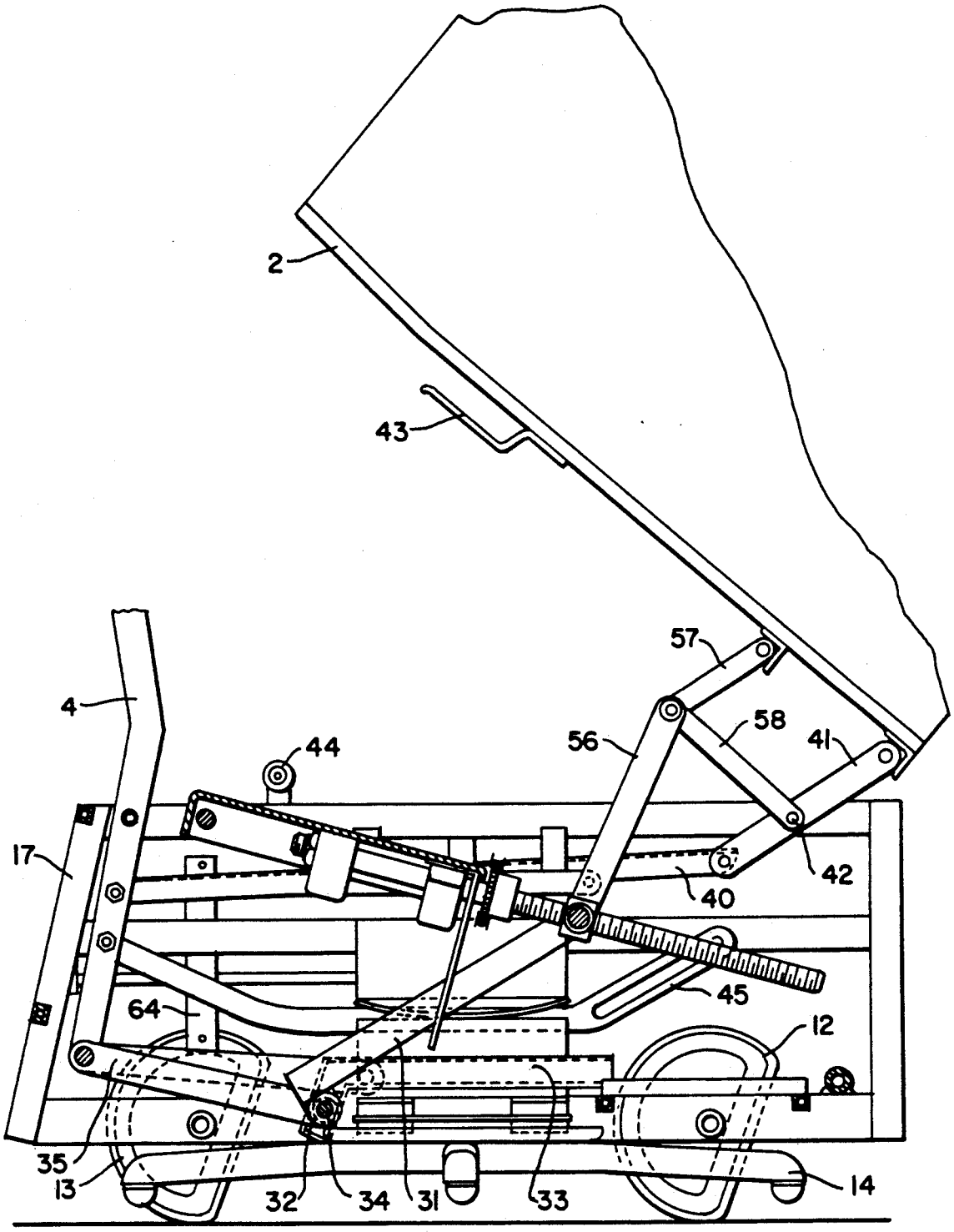
FIG. 9 shows a side view of the chair assembly in the lift position.

In the lift mode shown in FIGS. 3 and 9, the initial movement of the power cross bar 30 toward the back of the chair forces the guide rollers 32 into the lower bent ends of the guide channels 33. This movement also forces the lower power bars 31 to move the chain drive bars 36 backward, thus pulling the wheels 12 and 13 backward to disengage the swivel base 14 by firmly supporting the chair on the rounded portions of all four wheels 12 and 13.

In order to lift the back of the seat 2, upper power bars 56 on each side of the chair are attached in a pivotal manner at their lower ends to the power cross bar 30 and attached in a pivotal manner at their upper ends to the lower ends of first lift linkages 57 and second lift linkages 58 on each side of the chair. The upper ends of the first lift linkages 57 attach in a pivotal manner to the forward part of the seat 2 on each respective side. The upper ends of the second lift linkages 58 connect at the seat pivot cross bar 42 that is attached at both ends to the upper part of the main frame 17. This mechanical linkage allows the seat 2 to lift higher about the seat pivot cross bar 42 as the power cross bar 30 continues to move toward the back of the chair, while preventing the seat 2 from being strained when the front of the seat 2 is elevated in the recline mode.

Figure 13:
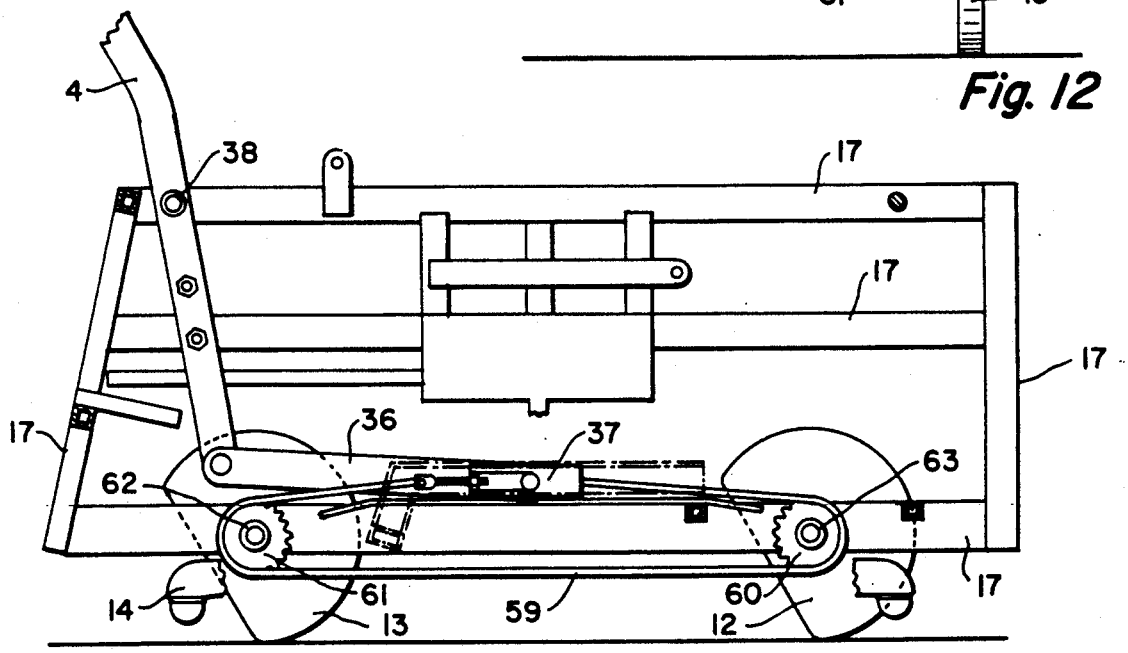
FIG. 13 shows a rear view of the chair assembly featuring the details of the rear brake mechanism.

As illustrated in FIG. 12 and previously explained, the wheels 12 & 13 are operated by the chain drive bars 36 that are attached at their rear end to the lower power bars 31 and attached to the chain turnbuckles 37 at their front ends. The use of these chain turnbuckles 37 allows for proper tensioning of the chain between the wheels 12 & 13. The wheel chains 59 tie the wheels 12 & 13 on each side of the chair together by front and rear wheel sprockets 60 & 61 so that they operate in unison. The rear wheels 13 and rear sprockets 61 are keyed onto each end of a cross axle 62. Stub axles 63 are mounted on each side of the lower part of the main frame 17 for the front wheels 13. The front wheels 12 and the front wheel sprockets 60 are both keyed to these stub axles 63. Referring to FIG. 13, the two rear wheels 13 are equipped with a caliber type brake 64 with a small shoe pad 65 located on the side of the wheel 13 so that the brakes 64 go on just as the rear wheels 13 roll off the corner of the flat sides. These brakes 64 prevent the chair from suddenly surging forward or backward.

Figure 14:
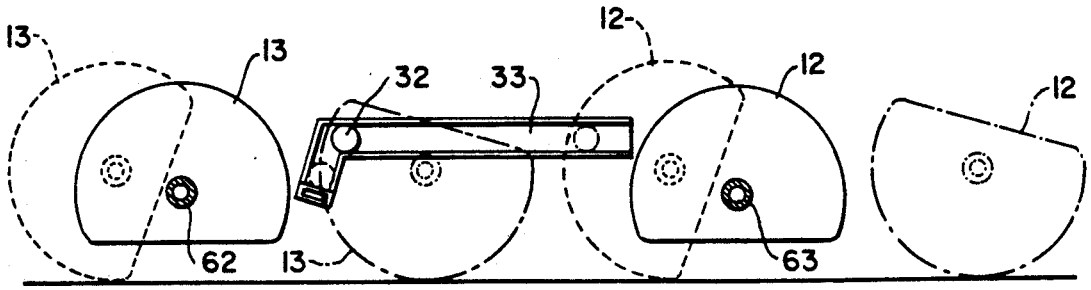
FIG. 14 shows a side view of the chair featuring the positions of the wheels and the guide roller in the lift, rock and swivel, and recline modes of operation.

In the normal sequence of operation, the chair begins with the seat 2 in the lift position and the chair resting on all four wheels 12 and 13 as shown in FIG. 14 by the uniform dashed image of the wheels 12 and 13 and the guide roller 32. The occupant leans back against the seat and presses the switch 1 to the down position. The power cross bar 30 moves away from the motor 19 to ease the seat 2 into a level position, at which point the chair is supported on the wheels at the back corner of the flat side. If the rock and swivel mode is desired, the switch 1 is pressed again in the down position until the power cross bar 30 moves further away from the motor 19 to pull the lower power bars 31, first recline linkages 35, and chain drive bars 36 forward and, consequently, roll the wheels 12 and 13 forward off the back corner of the flat side so that the flat side faces the floor as shown in FIG. 14 by the solid image of the wheels 12 and 13 and guide roller 32. Referring to FIG. 4, a small white indicator light 66 near the switch 1 comes on at this point in time to indicate that the chair is now supported by the swivel base 14 so that it can rock or swivel and that the wheels 12 and 13 are in a position to allow for maximum rocking action.

If the occupant wishes to assume a reclining position, the switch 1 is again pressed in the down position to move the power cross bar 30 away from the motor 19 and move the wheels 12 and 13 forward to the front corner of the flat side. Keeping the switch 1 in the down position reclines the back 4, rolls the wheels 12 & 13 forward, lifts the front of the seat 2, and lifts the footrest 6 until the desired angle of recline is reached or until it comes to a stop automatically at the maximum reclining position as shown in FIG. 14 by the alternating dashed image of the wheels 12 and 13 and guide roller 32. When the occupant desires to return to a sitting mode, the occupant presses the switch 1 in the up position and the back 4 rises to the upright sitting position, the wheels 12 and 13 roll backward, and the front of the seat 2 and the leg rest 6 return to the upright sitting position.

If the switch 1 is again pressed in the up position, the chair moves backward to the position where the flat sides of the wheels once again face the floor and the chair is supported by the swivel base 14. Keeping the switch 1 in the up position rolls the wheels 12 and 13 backward to the back corner of the flat side and then, with the chair firmly supported on the wheels 12 and 13, lifts the rear of the seat 2 to assist the occupant out of the chair.

The chair can be modified to a more traditional recline mode in which it does not travel forward and away from the wall as it reclines. This more traditional mode is accomplished by changing the size and position of the chain drive bars 36 so that they attach in a pivotal manner higher on the back 4 and reduce the travel of the wheel chain 59 to permit all recline operations while limiting the wheel movement from one corner of the flat side to the other, at which two positions the chair is stable. In either the normal roll forward or traditional recline mode, a red indicator light 67 near the switch 1 (see FIG. 4) comes on whenever the chair is between these two stable positions to show the user that the chair could rock or swivel if the user tries to sit in it.

While a presently preferred embodiment of practicing the invention has been shown and described with particularity in connection with the accompanying drawings, the invention may otherwise be embodied within the scope of the following claims:

What is claimed:

1. A power operated, multi-position chair having a main frame, a seat attached in a pivotal manner to the mainframe, two armrests attached to the seat, a back attached at back pivots to the main frame, a footrest attached to the mainframe, and a switch to control the chair's positions comprising:

(a) a recline mechanical linkage that allows the chair to operate in a recline mode wherein it reclines the back, lifts the front of the seat, and lifts the footrest;

(b) a seat lift mechanical linkage that allows the chair to operate in a seat lift mode wherein it lifts the back of the seat;

(c) a guide roller mechanically linked to both the recline mechanical linkage and the seat lift mechanical linkage;

(d) a guide channel in which the guide roller operates to activate either the recline mechanical linkage or the seat lift mechanical linkage; and (e) a power source with mechanical means to move the guide roller in the guide channel so that the chair can operate through its recline mode and seat lift mode; the power source with mechanical means comprising:

(f) a motor;

(g) a motor mount plate mounted in a pivotal manner on the main frame of the chair;

(h) a first power screw connected to the motor;

(i) a power cross bar with a first nut through which the power screw turns to move the power cross bar forward away from the motor as the screw turns counterclockwise (as viewed from the motor) and to pull the power cross bar toward the motor as the power screw turns clockwise (as viewed from the motor); and (j) a lower power bar connected in a pivotal manner at its front end to the power cross bar and connected at its rear end to the guide roller.

2. The chair as described in claim 1 wherein the guide channel has a front portion which is mounted in a substantially horizontal position and a back portion which bends downward and forms an angle of between 55° and 85° with the front portion.

3. The chair as described in claim 1 wherein the switch is a single rocker switch that controls all positions of the chair.

4. The chair as described in claim 1 wherein the seat, the armrests, the back, or the footrest are padded and removable and the chair further comprises finishing panels consisting of two inside arm panels, two front arm panels, two outside arm panels, two lower skirt panels, and a back panel, all of which are removable.

5. The chair as described in claim 1 further comprising a second power screw and nut mounted parallel to the first power screw and first nut such that both are driven by the motor through screw sprockets mounted on each power screw by chains driven from two motor sprockets mounted to the power shaft of the motor.

6. The chair as described in claim 5 wherein the screw sprockets are made from an insulating material.

7. The chair as described in claim 1 wherein the recline mechanical linkage comprises:

(a) a first recline linkage attached in a pivotal manner at its front end to the rear end of the lower power bar with its rear end attached in a pivotal manner to the back at a point below the back pivots;

(b) a second recline linkage connected in a pivotal manner at its rear end to the back at a point below the back pivots;

(c) a seat rocker connected in a pivotal manner at its lower end to the front end of the second recline linkage and connected in a pivotal manner at its upper end to the front of the seat, with a connection to the mainframe at a seat pivot; and (d) a third recline linkage attached in a pivotal manner at its rear end to a point of the back below the back pivots and connected at its front end to a pantograph linkage which in turn is connected to the footrest.

8. The chair as described in claim 7 further comprising a manually operated handbar attached to a means to hold the footrest in an elevated position even if the chair is returned to its upright position.

9. The chair as described in claim 7 wherein seat keepers are mounted on each side of the rear of the seat to slide under seat rollers mounted on the main frame on each side of the chair as the seat moves backward in the recline mode.

10. The chair as described in claim 9 wherein the seat lift mechanical linkage comprises:

(a) an upper power bar attached in a pivotal manner at its lower end to the power cross bar;

(b) a first lift linkage attached in a pivotal manner at its lower end to the upper end of the upper power bar with the upper end attached in a pivotal manner to the front part of the seat; and (c) a second lift linkage attached in a pivotal manner at its lower end to the upper end of the upper power bar and connected at its upper end to the main frame at a seat pivot.

11. The chair as described in claim 10 wherein the guide roller, the guide channel, the recline mechanical linkage, and the seat lift mechanical linkage are mounted on both the left and the right sides of the chair.

12. The chair as described in claim 11 wherein the left and right lower power bars are connected to opposite ends of the power cross bar, the left and right guide rollers are connected to opposite ends of a guide cross bar, the rear of the left and right first recline linkages are connected to opposite ends of a back cross bar, and the left and right seat rockers are connected at a midpoint to a seat pivot cross bar that attaches to the right and left sides of the main frame.

13. The chair as described in claim 1 that further comprises a rock and swivel means that allows the chair to rock or swivel.

14. The chair as described in claim 13 wherein the rock and swivel means comprises:

(a) a floor support;

(b) a swivel mounted in the floor support;

(c) a swivel base connected to the swivel;

(d) a rocker contact connected to the mainframe of the chair that contacts the swivel base to support the chair when the floor support is in contact with a floor; and (e) two or more springs mounted to the rocker contact on one end and mounted to the swivel base on the other.

15. The chair as described in claim 13 wherein the power source with mechanical means moves the chair from the rock and swivel mode, in which the chair is supported by the rock and swivel means, to either the recline mode or the seat lift mode by using chair supports that are connected to the mainframe in a pivotal manner and are rotated forward or backward by a movement means to move the supports so that they support the chair directly during recline or seat lift operations.

16. The chair as described in claim 13 wherein the power source with mechanical means moves the chair from the rock and swivel mode, in which the chair is supported by the rock and swivel means, to either the recline mode or the seat lift mode by using wheels with a flat side, positioned with the flat side facing the floor when the chair is supported on the rock and swivel base, that are rotated forward or backward by a movement means to move the wheels so that they support the chair directly from the rounded portion of the wheels during recline or seat lift operations.

17. The chair as described in claim 16 wherein the movement means to move the wheels comprises:

(a) a cross axle between the rear wheels;

(b) rear sprockets keyed to each end of the cross axle;

(c) stub axles mounted to the main frame and connected to the front wheels;

(d) front sprockets keyed to the stub axles;

(e) a wheel chain running around the front and rear sprockets; and (f) a chain turnbuckle attached to each end of the wheel chain; and (g) a chain drive bar connected in a pivotal manner at its front end to the chain turnbuckle and attached in a pivotal manner at its rear end to the back at a point below the back pivots.

18. The chair as described in claim 16 wherein the rear wheels are equipped with a caliper brake and brake shoe pads located on the rear wheels so that the brakes go on just as the rear wheels roll off a corner of the flat side of the wheels.

19. The chair as described in claim 13 wherein the switch features a white light that comes on when the chair is in its maximum rocking position, as well as a red light that comes on any time the chair is supported by the rock and swivel means.

* * * * *